US007932011B2

(12) United States Patent
Ueda et al.

(10) Patent No.: US 7,932,011 B2
(45) Date of Patent: Apr. 26, 2011

(54) ELECTROPHOTOGRAPHIC TONER AND MANUFACTURING METHOD THEREOF

(75) Inventors: Takamasa Ueda, Hachioji (JP); Mikio Koyama, Kunitachi (JP); Kazuya Isobe, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 666 days.

(21) Appl. No.: 11/361,535

(22) Filed: Feb. 24, 2006

(65) Prior Publication Data

US 2006/0216624 A1 Sep. 28, 2006

(30) Foreign Application Priority Data

Mar. 23, 2005 (JP) ..... 2005-083305

(51) Int. Cl.
*G03G 9/08* (2006.01)

(52) U.S. Cl. ..... 430/137.14; 430/108.4; 430/110.1; 430/109.3; 430/108.8; 430/108.1

(58) Field of Classification Search ..... 430/108.4, 430/110.1, 109.3, 108.8, 108.1, 137.14
See application file for complete search history.

(56) References Cited

U.S. PATENT DOCUMENTS

| | | | | |
|---|---|---|---|---|
| 5,712,072 | A * | 1/1998 | Inaba et al. | 430/108.4 |
| 2002/0072005 | A1 * | 6/2002 | Kohtaki et al. | 430/108.21 |
| 2004/0131962 | A1 * | 7/2004 | Nakamura et al. | 430/108.21 |
| 2004/0191660 | A1 * | 9/2004 | Otsuka et al. | 430/108.23 |
| 2005/0074685 | A1 * | 4/2005 | Kido et al. | 430/110.2 |

FOREIGN PATENT DOCUMENTS

| | | |
|---|---|---|
| JP | 11-149187 | 6/1999 |
| JP | 2000-066438 | 3/2000 |
| JP | 2000-267347 | 9/2000 |
| JP | 2002-006542 | 1/2002 |

* cited by examiner

*Primary Examiner* — Christopher RoDee
*Assistant Examiner* — Rachel L Zhang
(74) *Attorney, Agent, or Firm* — Lucas & Mercanti, LLP

(57) ABSTRACT

An electrophotographic toner comprising a resin and a colorant, wherein:

(i) a toner particle comprises a domain in the toner particle, the domain comprising a polar wax having a first polar group and a non-polar wax; and (ii) the resin contains a second polar group.

11 Claims, 1 Drawing Sheet

ELECTROPHOTOGRAPHIC TONER AND MANUFACTURING METHOD THEREOF

FIELD OF THE INVENTION

The present invention relates to an electrophotographic toner and a manufacturing method of the same.

BACKGROUND OF THE INVENTION

In recent years, the number of full-color images is increasing in the field of electrophotography. In full-color images, an image is formed of a larger number of pixels compared to text images. Therefore, images have a tendency to have more regions of so-called solid image. Since a larger amount of toner passes through the fixing apparatus while fixing an image having such solid regions, generally silicone oil has been utilized to prevent offset when a fixing apparatus having a contact member is used. Although offset is reduced by employing silicone oil, silicone oil may remain on the image surface to cause glare or difficulty in additional writing on the image. Further, when silicone oil remains unevenly on the image surface, the image quality may be deteriorated due to the unevenness of the image.

To overcome this problem, a release agent, typically a wax, is incorporated to the toner to make silicone oil unnecessary when the image is fixed. Namely, an oil-less fixing method has been employed these days. However, in this method, as a result of toner being continuously subjected to a mechanical load due to friction with the contact member such as an image holding member or a development sleeve, the toner is crushed and exhibits a significantly different shape from the shape of the initial toner, which may cause unfavorable influence on the processes of electrostatic charging, developing, transferring and fixing.

However, since a transport device employing a contact member is a simple and efficient transport means, it may be difficult to be replaced with other methods. Accordingly, at present, a method to provide stable images using a full-color image formation method has not been fully established.

Further, solution of the above-described problem has become more important for a so-called polymerized toner than for a pulverized toner, because, even for the polymerized toner which has recently been widely employed, oil-less fixing is becoming a main current as a fixing method, since addition of a release agent in the production process is easier for the polymerized toner.

Also, in view of a desire to conservation of resources and energy, a fixing process, which consumes the largest energy among electrophotographic processes, is expected to carry out at a lower temperature and in a simple operation. In this point of view, the above-described oil-less fixing method is advantageous for a low temperature and simple operation.

In the above-described background, mechanical durability of toner is deteriorated in a long term usage because of mechanical stress at the time of development in a non-magnetic single-component development method and mechanical stress by high speed mixing in a high speed two-component method, and as a result, particularly, induced are problems of increase in a smaller particle size component due to crushed toner and offset or adhesion thereof on such as a sleeve, whereby significant deterioration of image quality is caused.

Recently, it has been confirmed that crush of the toner occurs at the interface between resin and a release agent, and that this phenomenon is particularly significant in a development method employing a low temperature fixing toner having a tendency of softening and in an oil-less toner which utilizes more amount of a self-contained release agent, which is in well coincidence with the aforesaid estimated reason.

Therefore, in order to solve the problem, desired is the increase in the strength of the interface between the resin and the release agent in a toner, namely, more specifically, desired is the increase in the adhesion at the interface between the resin and the release agent. For this purpose, it was found that incorporation of a polar group in both of resin and a release agent is effective to increase the affinity between the resin and the release agent, whereby the interface adhesion is improved. In this case, single use of a polar wax does not provide a fully satisfactory releasing property due to the compatibility of the wax with the polar resin. Therefore, it was found that preferable is a constitution in which a polar wax and a non-polar wax are utilized in combination in order to form a domain structure in a toner as well as to continuously increase the polar wax content from the inside to the out side in the interior of each domain. Techniques to distinctively utilize a polar wax and a non-polar wax are commonly known (for example, refer to Patent Documents 1-3), however, these are not to depress crush of a toner as will be described in the present invention, in which polar and non-polar waxes are utilized to improve the interface adhesion due to an interaction between the wax and the polar resin.

Patent Document 1 JP-A No. 11-149187 (JP-A refers to Japanese Patent Publication Open to Public Inspection)

Patent Document 2 JP-A No. 2000-267347

Patent Document 3 JP-A No. 2002-6542

SUMMARY OF THE INVENTION

An object of the present invention is to provide an electrophotographic toner, which can improve in resistance for crushing of the toner while development caused by mechanical stress in a non-magnetic, single-component development method and mechanical stress by high speed mixing in a high speed two-component method, and can improve in an anti-peeling property, a releasing property (an anti-offset property) and environmental stability of electrostatic charging property, as well as to provide a manufacturing method thereof.

One of the aspects of the present invention is an electrophotographic toner comprising a release agent, a resin and a colorant, wherein: (i) the release agent forms a domain in a toner particle, the domain comprising a polar wax and a non-polar wax; and (ii) the resin contains a polar group.

DESCRIPTION OF THE PREFERRED EMBODIMENTS

Figure 1:
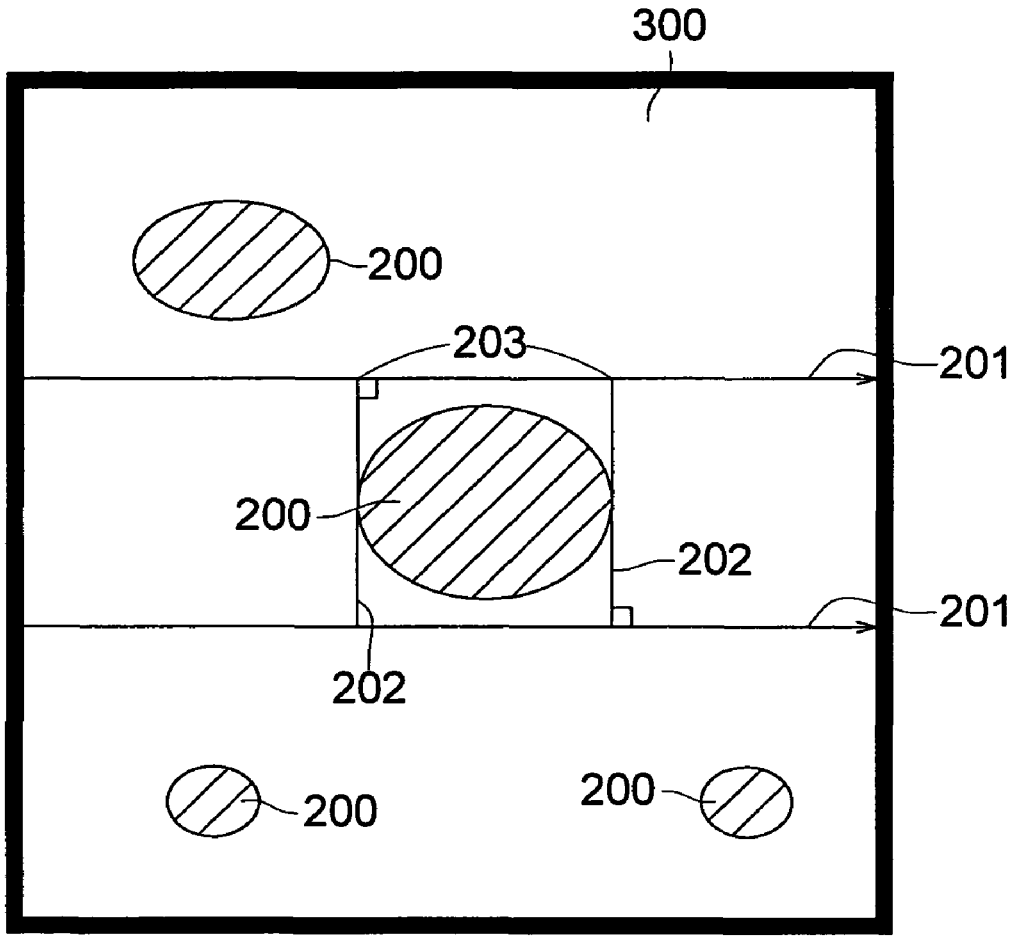
FIG. 1 is a schematic illustration explaining a method to determine a Feret diameter.

The present invention provides an electrophotographic toner, which can improve in resistance for crushing of the toner while development caused by mechanical stress in a non-magnetic, single-component development method and mechanical stress by high speed mixing in a high speed two-component method, and can improve in an anti-peeling property, a releasing property (an anti-offset property) and environmental stability of electrostatic charging property. The present invention also provides a manufacturing method thereof.

An electrophotographic toner of the present invention can be manufactured by repeating one or two times the following steps, in which at least a polymer primary particle dispersion and a colorant particle dispersion are mixed in advance and inorganic metal salt is added into this dispersion while stirring to aggregate and fuse each particles to prepare mother particles, and a successive step, in which a polymer primary particle dispersion identical to or different from the aforesaid polymer primary particle dispersion was added thereto to be aggregated and fused on the mother particles to form an outer layer, to form capsule layers.

Polymer primary particles utilized in an electrophotographic toner of the present invention include radical polymerizable resin such as (meth)acrylic ester resin and aromatic vinyl resin, and condensation polymerization resin such as polyester resin, having a volume median diameter of 80-200 nm and preferably of 100-150 nm.

Polymer primary particles may be manufactured by any wet method, and such as an emulsion polymerization method, a suspension polymerization method and an emulsion dispersion method can be applied. In the following, polymer primary particles manufactured by an emulsion polymerization method will be explained as an example; however, components and manufacturing methods of polymer primary particles employable in the present invention are not limited thereto.

As a polymerizable monomer preferably used for preparing polymer primary particles by an emulsion polymerization method, included is a radical polymerizable monomer as an essential constituent component, and specifically, at least one selected from radical polymerizable monomers having a polar group. In the present invention, the weight content of a radical polymerizable monomer having a polar group is preferably 0.1-15% by weight and more preferably 1-12% by weight, based on the total weight of the monomers (the mixture of the monomers). Further, a cross-linking agent may be appropriately incorporated.

Specific examples of a polar group include a carboxyl group, a hydroxyl group, a nitro group, an amido group, an amino group, an imido group, a thiol group, an ammonium group, a sulfonic group, a phosphoric group, a heterocyclic group and a sulfide group and so on. Of these, preferable are a carboxyl group and a hydroxyl group. It is preferable to be the weight content of a radical polymerizable monomer having a polar group not less than 0.1% by weight based on the total weight of the mixture of the monomers, because the compatibility with the polar wax becomes excellent, resulting in improving the adhesiveness at the interface between the resin and the wax. Also, the weight content of not more than 15% by weight is preferable, because the compatibility with the polar wax becomes appropriate, resulting in improving the releasing property of the toner.

Examples of a radical polymerizable monomer include an aromatic vinyl monomer and a (meth)acrylic ester monomer.

Examples of an aromatic vinyl monomer includes: styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimthylstyrene and 3,4-dichlorostyrene; and derivatives thereof.

Examples of a (Meth)acrylic ester monomer includes: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

As a cross-linking agent, a radical polymerizing cross-linking agent may be incorporated to improve characteristics of toner. Radical polymerizing cross-linking agents include those provided with at least two unsaturated bonds such as divinyl benzene, divinyl naphthalene, divinyl ether, diethylene glycol methacrylate, ethylene glycol dimethacrylate, polyethylene glycol dimethacrylate and diallyl phthalate.

To adjust the molecular weight of a resin, a common chain transfer agent may be utilized. Chain transfer agents utilized are not specifically limited and include mercaptans such as octyl mercaptan, dodecyl mercaptan and tert-dodecyl mercaptan; and styrene dimmer.

Radical polymerization initiators utilized in the electrophotographic toner of the present invention are suitably usable provided that it is water-soluble. Listed are, for example, persulfates such potassium persulfate and ammonium persulfate; azo compounds such as 4,4'-azobis-4-cyanovalerate and salts thereof, and 2,2'-azobis(2-amidinopropane) salt; and peroxide compounds. Further, radical polymerization initiators described above may be appropriately utilized as a redox initiator in combination with a reducing agent if necessary. By utilizing a redox initiator, polymerization reactivity is increased enabling a lower polymerization temperature in addition to a shorter polymerization time.

At the time of emulsion polymerization being performed by utilizing the aforesaid radical polymerizable monomer, surfactants employable are not specifically limited; however, ionic and nonionic surfactants described below are suitably employed.

Examples of ionic surfactants include: sulfonates (such as sodium dodecylbenzene sulfonate, sodium arylalkyl polyether sulfonate, sodium 3,3-disulfondiphenylurea-4,4-diazo-bis-amino-8-naphthol-6-sulfonate, ortho-carboxybenzene-azo-dimethylaniline and sodium 2,2,5,5-tetramethyl-triphenylmethane-4,4-diazo-bis-β-naphthol-6-sulfonate), sulfuric ester salts (such as sodium dodecylsulfate, sodium tetradecylsulfate, sodium pentadecylsulfate and sodium octylsulfate) and fatty acid salts (sodium oleate, sodium laurate, sodium caprate, sodium caprylate, sodium caproate, potassium stearate and calcium oleate).

Nonionic surfactants include such as polyethylene oxide, polypropylene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide and sorbitane ester, however, polymerization may be performed by appropriately utilizing these nonionic surfactants in combination with the aforesaid ionic surfactant.

In the present invention, a nonionic surfactant is utilized for the purpose of dispersion stabilization of each particles in an aggregation process and of adjustment of aggregation power of dispersed particles, in addition to as an emulsifying agent at the time of emulsion polymerization. That is, since nonionic surfactant significantly decreases dispersion stabilization power of particles at a temperature of not lower than the clouding point, it becomes possible to adjust aggregation power between particles based on control of the aggregation temperature to achieve uniform and efficient aggregation of particles.

As another polymerizable composition, modified polyester liquid droplets may be polymerized using a molecule elongation agent to prepare toner particles. Specifically, the toner composition containing: (i) a modified polyester resin prepared by reacting a polyester resin (A), which has been modified so as to be reactive with an active hydrogen, with an elongation agent and/or a cross-linking agent (B); and (ii) non-modified polyester resin, are dissolved or dispersed in an organic solvent, and the resulting system is further added with said elongation agent and/or said cross-linking agent (B) to perform polymerization.

As polyester resin (A) which has been modified to be reactive with active hydrogen, polyester prepolymer (A) having an isocyanate group is preferably utilized. Polyester prepolymer having an isocyanate group includes such as polycondensates of polyol and polycarboxylic acid, in which the resulting polyester having an active hydrogen group is further reacted with polyisocyanate. Example of an active hydrogen group which is incorporated in the above-described polyester include: a hydroxyl group (an alcoholic hydroxyl group and a phenolic hydroxyl group), an amino group, a carboxyl group and a mercapto group. Of these, preferable is an alcoholic hydroxyl group.

Examples of a diol include: alkylene glycols (such as ethylene glycol, 1,2-propyrene glycol, 1,3-propylene glycol, 1,4-butane diol and 1,6-hexane diol); alkylene ether glycols (such as diethylene glycol, triethylene glycol, dipropylene glycol, polyethylene glycol, polypropylene glycol and polytetramethylene ether glycol); alicyclic diols (such as 1,4-cyclohexane dimethanol and hydrogenated bisphenol A); bisphenols (such as bisphenol A, bisphenol F and bisphenol S); adducts of the above-described alicyclic diols added with alkylene oxide (such as ethylene oxide, propylene oxide and butylenes oxide); and adducts of the above-described bisphenols added with alkylene oxide (such as ethylene oxide, propylene oxide and butylenes oxide). Of these, preferable are alkylene glycols having a carbon number of 2-12 and adducts of bisphenols added with alkylene oxide, and specifically preferable are adducts of bisphenols added with alkylene oxide and simultaneous use of the above described adduct of bisphenol and an alkylene glycol having a carbon number of 2-12.

Example of polyisocyanate includes: aliphatic polyisocyanates (such as tetramethylene diisocyanate, hexamethylene diisocyanate and 2,6-diisocyanato methylcaproate); alicyclic polyisocyanates (such as isophorone diisocyanate and cyclohexylmethane diisocyanate); aromatic diisocyanates (such as trilene diisocyanate and diphenylmethane diisocyanate); aromatic aliphatic diisocyanate (such as $\alpha,\alpha,\alpha',\alpha'$-tetramethylxylene diisocyanate); isocyanurates; the above described polyisocyanates blocked with such as a phenol derivative, oxime or caprolactam; and combination use of two or more thereof.

The molar ratio of polyisocyanate represented by the molar ratio of isocyanate group [NCO] to hydroxyl group [OH] of polyester having a hydroxyl group, namely, [NCO]/[OH], is generally 5/1-1/1, preferably 4/1-1.2/1 and more preferably 2.5/1-1.5/1. When [NCO]/[OH] is over 5, lower temperature fixing property becomes deteriorated. Alternatively, when [NCO]/[OH] is less than 1, the urea content in modified polyester becomes low, resulting in deterioration of resistance for hot offset of the toner. The content of a polyisocyanate component in prepolymer having an isocyanate group at the end is generally 0.5-40% by weight, preferably 1-30% by weight and more preferably 2-20% by weight. When it is less than 0.5% by weight, resistance for hot offset, high temperature storage stability and the lower temperature fixing property are deteriorated. Also, when it is over 40% by weight, the lower temperature fixing is deteriorated.

The number of isocyanate group contained per one molecule in prepolymer having an isocyanate group are generally 1, preferably 1.5-3 and more preferably 1.8-2.5. When it is less than 1 per one molecule, a molecular weight of modified polyester resin, having been cross-linked and/or elongated, becomes small, whereby resistance for hot offset is deteriorated.

In the present invention, as an elongation agent and/or a cross-linking agent, an amine is preferably utilized. Examples of an Amine include: diamine, polyamine of trivalent or more, amino-alcohol, aminomercaptane, amino acid and the above described amino compounds of which an amino group is blocked. Examples of diamine include: aromatic diamines (such as phenylene diamine, diethyltoluene diamine and 4,4'-diaminodiphenylmethane); alicyclic diamines (such as 4,4'-diamino-3,3'-dimethyldicyclohexylmethane, diamine cyclohexane and isophorone diamine); and aliphatic diamines (such as ethylene diamine, tetramethylene diamine and hexamethylene diamine). Examples of polyamine of trivalent or more includes: diethylene triamine and triethylene tetramine. Examples of an amino-alcohol include: ethanol amine and hydroxylethyl aniline. Examples of aminomercaptane include: aminoethylmercaptane and aminopropylmercaptane. Examples of amino acid include aminopropionic acid and aminocaproic acid.

Examples of compounds, in which amino groups of diamine, polyamine, amino-alcohol, aminomercaptane and amino acid are blocked include: (i) ketimine compounds prepared from amines such as diamine, polyamine, amino-alcohol, aminomercaptane and amino acid, and ketones (such as acetone, methyl ethyl ketone and methyl isobutyl ketone); and (ii) oxazoline compounds. Among these amines, preferable are diamine and a mixture of diamine and a small amount of polyamine.

Further, by appropriately utilizing a cross-linking agent and/or an elongation stopping agent, a molecular weight of modified polyester after the reaction is completed can be controlled. Examples of an elongation stopping agent include monoamines (such as diethylamine, dibutylamine, butylamine and laurylamine) and blocked compounds thereof (ketimine compounds).

The molar ratio of an isocyanate group [NCO] in prepolymer having an isocyanate group to an amino group in amines [NHx], namely, [NCO]/[NHx], is generally 1/2-2/1, preferably 1.5/1-1/1.5 and more preferably 1.2/1-1/1.2.

Next, the release agent of the present invention will be explained.

Polar wax contains a polar group which is at least one selected from the group of: a heterocyclic group, a carboxyl group, an ester group, an ether group, a hydroxyl group, an amido group, an imido group, a nitro group, an amino group, an ammonium group, a sulfonyl group, a thiol group and a sulfide group. In the present invention, the weight content of wax having a polar group is 0.1-15% by weight and preferably 1-12% by weight, based on the total weight of the wax.

It is preferable to be the weight content of wax having a polar group not less than 0.1% by weight based on the total weight of the wax, because the compatibility with the polar resin becomes excellent, resulting in improving the adhesiveness at the interface between the resin and the wax. Also, the weight content of not more than 15% by weight is preferable, because the compatibility with the polar resin becomes good, resulting in improving the releasing property of the toner.

Specific examples of polar wax of the present invention include: oxidized wax prepared by air oxidation of petroleum wax or Fischer-Tropsch wax; petroleum wax; alcohol-based wax prepared by air oxidation of $\alpha$-olefin wax or Fischer-Tropsch wax, both having a double bond at the terminus, in the presence of boric acid; urethane wax prepared by reacting the aforesaid alcohol-based wax with tolylene diisocyanate; ester wax prepared by reacting an acid component such as stearic acid or behenic acid with an alcohol component such as stearyl alcohol, behenyl alcohol or 1,4-butane diol; ester wax prepared by removing a low melting point component from Rice bran wax or Carnauba wax by a solvent treatment or by use of short-path distillation (flow type or centrifugal type); ketone wax prepared by high temperature decarboxylation of stearic acid in the presence of a metal oxide catalyst; and 3-pentadecylphenoxy acetate prepared by reacting 3-pentadecylphenol, which is a hydrogenated product of cashew nut oil, with chloro acetate. Other examples include: fatty acid wax having a carbon number of 12-24 and ester compounds thereof; higher alcohol-based wax, synthetic wax containing lanolin, Carnauba wax, Rice wax, Bee's wax, Scale insect wax and Montan wax. Herein, for alcohol-based wax, a hydroxyl value is defined, which is similar to an acid value of acid-based wax, which is also one of a measure of the polarity.

Non-polar wax of the present invention is a compound having a Y/X value of 0-1/20, provided that a carbon number is represented as X and a hetero atom number is represented as Y. Non-polar wax is preferably alkene or alkane which may have a substituent. And the acid value of the non-polar wax is preferably 0-0.1 mgKOH/g.

Further, specific examples of non-polar wax include: petroleum wax, low molecular weight polyethylene wax and low molecular weight polypropylene wax. Further, the wax of the present invention is characterized by having a weight mixing ratio of polar wax to non-polar wax of 1/40-40/40, and when the mixing ratio is not less than 1/40, improvement in interface adhesion becomes excellent, while, when it is not more than 40/40, the wax becomes excellently compatible with polar resin, resulting in improving releasing property which is an essential function of the release agent.

Both polar wax and non-polar wax preferably have an endothermic peak (corresponding to a melting point) of 60-110° C. in DSC measurement. Wax having a melting point of not less than 60° C. tends not to cause thermal aggregation when being blended in toner, resulting in improving storage stability of the toner. While, wax having a melting point of not more than 110° C. does not require large energy to fuse toner in the fixing process, which is unfavorable with respect to energy saving. Further, both polar wax and non-polar wax preferably have an exothermic peak (corresponding to a crystallization temperature) of 55-100° C.

Specific measurement apparatuses of DSC include such as DSC-7 produced by Perkin-Elmar Inc. and DSC-200 produced by Seiko Instruments Inc. As a general method of the measurement, for example, a sample, after having been kept at 0° C. for 1 minute, is heated to 200° C. at a constant heating rate, and the largest peak measured in this heating process is an endothermic peak, while thereafter the sample, having been kept at 200° C. for 1 minute, is cooled at a constant cooling rate, and the maximum peak measured in this cooling process is an exothermic peak.

Further, a fixing aid can be utilized in combination.

As a colorant utilized in the present invention, utilized can be pigment well known in the art and conventionally utilized as a colorant for a full-color toner. For example, listed are carbon black, aniline blue, charcoyl blue, Chrome Yellow, ultramarine blue, Du Pont Oil Red, quinoline yellow, methylene blue chloride, copper phthalocyanine, malachite green oxalate, lamp black, Rose Bengal, C. I. Pigment Red 48:1, C. I. Pigment Red 122, C. I. Pigment Red 57:1, C. I. Pigment Red 184, C. I. Pigment Yellow 97, C. I. Pigment Yellow 12, C. I. Pigment Yellow 17, C. I. Solvent Yellow 162, C. I. Pigment Yellow 180, C. I. Pigment Yellow 185, C. I. Pigment Blue 15:1 and C. I. Pigment Blue 15:3.

In the present invention, a charge control agent and a magnetic powder may be incorporated in toner particles in addition to the release agent which is the above-described wax. The addition amount of a release agent is preferably 0.5-15 weight parts and preferably 1-13 weight parts, in 100 weight parts of binder resin. When at least two waxes are utilized as a release agent, the total amount of the waxes is preferably in the above-described range.

As a charge control agent, utilized can be charge control agents which are well known in the art and conventionally utilized to control charging capability in the field of an electrostatic development toner. For example, fluorine-containing surfactants, salicylic acid metal complexes, metal containing dyes such as azo metal compounds, polymer acids such as copolymer containing maleic acid as a monomer component, quaternary ammonium salt, azine dyes such as nigrosine, and carbon black can be utilized. A charge control agent may be utilized at a ratio of 0.01-5 weigh parts and preferably 0.05-3 weight parts, against the 100 weight parts of the total binder resin.

An example of a manufacturing method of an electrophotographic toner of the present invention includes a polymerization process to prepare a polymer primary particle dispersion by use of the aforesaid radical polymerizable monomer, a mother particle forming process to prepare mother particles by mixing a polymer primary particle dispersion and a colorant particle dispersion in a water-based medium to aggregate and fuse each particle, a capsulation process to form a capsule layer by adding a polymer primary particle dispersion in a water-based dispersion of mother particles, a filtering-washing process to eliminate such as a surfactant from said toner particles by filtering out said toner particles from the prepared dispersion of capsulated toner particles, and a drying process to dry the toner particles having been washed. In the following, the outline of each process will be explained.

In the polymerization process, liquid drops of radical polymerizable monomer solution are formed in an aqueous medium (an aqueous solution of a surfactant and a radical polymerization initiator), and an emulsion polymerization reaction is carried out in the liquid drops, which is initiated by a radical from the radical polymerization initiator existing in the aqueous medium. As a surfactant to be added in a water-based medium, anionic surfactants and nonionic surfactants can be utilized, and these are added alone or by mixing to make a suitable composition. The polymerization temperature may be selected at any temperature provided being not lower than the lowest radical generating temperature of a polymerization initiator, however, for example, it is set in a range of 50-90° C. Herein, it is possible to perform polymerization at room temperature or a higher temperature by employing a polymerization initiator to initiate at ordinary temperature, for example, a combination of hydrogen peroxide and a reducing agent (such as ascorbic acid).

In a mother particle forming process, such as a colorant particle dispersion is mixed into the resin particle dispersion prepared by the aforesaid polymerization process and each particle is aggregated by salting out, further followed by being fused with heat. In said process, wax particles and inner additive particles of such as a charge control agent may be simultaneously fused.

Specifically, an electrophotographic toner containing resin particles, which contain polar wax and non-polar wax, according to the present invention was prepared by the following method.

Further, an electrophotographic toner of the present Invention can be prepared by associating, salting out and fusing resin particles which contain a mixture of polar wax and non-polar wax, and a colorant in an aqueous medium. Herein, resin particles can be prepared by emulsion polymerization or by seed polymerization employing each wax particle as a nucleus.

The size of a domain structure in a toner containing a mixture of polar wax and non-polar wax according to the present invention is preferable to be 0.1-1 μm, preferably 0.2-0.7 μm, as a number average horizontal Feret diameter. The content of polar wax is preferably higher in the vicinity of the resin particle surface, while the content of non-polar wax is preferably higher and the content of polar wax is preferably lower, in the interior. And, at the resin/wax interface, adhesion is improved due to interaction between the polar groups each other.

Herein, to measure a Feret diameter and a number average Feret diameter, the particles are observed through a transmission electron microscope with magnification of 10,000 to measure and calculate a Feret horizontal diameter by use of an image analyzer. In this case, the particles preferably have a uniform particle size so that not less than 70% by number is in a range of a mean Feret diameter ±10%. Herein, a Feret horizontal diameter of a particle utilized in the present invention represents the maximum length in one arbitrary direction of each particle with respect to the above plural number of particles photographed through an electron microscope. The maximum length refers to a distance between two parallel lines, which are drawn perpendicular to the above-described arbitrary direction and tangent to the circumference of a particle.

For example, in FIG. 1, one arbitrary direction 201 is determined with respect to photographed picture 300 of particle 200 by an electron microscope. The distance between two lines 202, which are vertical to aforesaid arbitrary direction 201 and tangent to each particle 200, is a Feret diameter 203.

Colorant particles can be prepared by dispersing a colorant in a water-based medium. Dispersion process of a colorant is performed under a state of setting surfactant concentration to not less than the critical micelle concentration (CMC). Utilizable surfactants include anionic surfactants and nonionic surfactants, which are utilized alone or by mixing at a suitable composition. Homogenizers utilized for a dispersion process of a colorant are not specifically limited; however, preferably include an ultrasonic homogenizer, a pressure homogenizer such as a mechanical homogenizer and a pressure type homogenizer, a medium type homogenizer such as a sand grinder and a diamond fine mill. Further, utilizable surfactants include those similar to the surfactants described before.

In a method to aggregate and fuse each particle, after adding a salting out agent, which is comprised of such as alkali metal salt and alkali earth metal salt, as a coagulant of a concentration not less than the critical aggregation concentration, into a water-based medium, in which resin particles and colorant particles are present, the system is heated to not lower than glass transition temperature Tg of the aforesaid resin particles, preferably to temperature t1 which satisfies Tg<t1<Tg+40° C.

Further, in the case that a nonionic surfactant, which has clouding point t3, satisfying Tg<t3<Tg+40° C. against Tg of polymer primary particles, is utilized to disperse and to improve dispersion stability of each particles, an aggregation efficiency (rate) is increased by performing aggregation at temperature t1 satisfying t1>t3.

Salting out agents utilized here include alkali metal salt and alkali earth metal salt, and alkali metal including univalent metal such as lithium, potassium and sodium; alkali earth metal salt including divalent metal such as magnesium, calcium, strontium and barium; as well as salt of not less than trivalent metal such as aluminum. Preferably listed are such as potassium, sodium, magnesium, calcium and barium, and those constituting salt include chloride, bromide, iodide, carbonate and sulfate.

A capsulation process is performed as follows: after adding one type of a polymer primary particle dispersion, which is identical to or different from one utilized to form mother particles, alone or by mixing into a dispersion of mother particles prepared in the aforesaid mother particle forming process, the resulting dispersion is heated to a temperature higher than Tg of this resin particles and preferably to temperature t2 satisfying Tg<t2<Tg+40° C., thereby these resin particles are aggregated and fused. At that time, by appropriately repeating this operation, it is possible to form a multiple capsule layers with a little mixing of resin between capsule layers.

Further, at the time of making the added resin particles adhere on the mother particle surface, it is possible to increase the adhesion rate by further addition of a coagulant having a valence identical to or not less than that of a coagulant utilized at the time of mother particle formation. A coagulant having a larger valence includes such as a trivalent aluminum salt and tetravalent poly-aluminum chloride.

Further, in the case that a nonionic surfactant having clouding point t3, satisfying Tg<t3<Tg+40° C. against Tg of polymer primary particles, is utilized to disperse and to improve dispersion stability of each particle, an aggregation efficiency (rate) is increased by performing aggregation at temperature t2 satisfying t2>t3.

A filtering and washing process performs a filtering treatment to filter out said toner particles from the dispersion of toner particles having been prepared in the above process, and a washing treatment to eliminate such as a surfactant and a salting out agent, which coexist with the toner particles, from the filtered toner particles. Herein, a filtration treatment method includes a centrifugal separation method, a reduced pressure filtration utilizing such as a Nutsche and a filtration method utilizing such as a filter press, however, is not limited thereto.

A drying process is a process to perform drying treatment of the washing treated toner particles. A dryer utilized in this process includes such as a spray dryer, a vacuum freeze dryer and a reduced pressure dryer, and preferably utilized are such as a standing shell dryer, a shifting shell dryer, a fluidized bed dryer, a rotational dryer and a stirring dryer. The water content of dried toner particles is preferably not more than 5% by weight and more preferably not more than 2% by weight. Further, in the case of toner particles being aggregated with a weak inter-particle attractive force, said aggregates may be subjected to a crushing treatment. Herein, as a crushing treatment apparatus, mechanical crushing apparatuses such as a jet mill and a HENSCHEL MIXER can be utilized.

At the time of toner particles manufactured in the above manner being subjected to an external addition treatment, as an external additive utilized, inorganic particles well known in the art, which have been utilized as a fluidity adjusting agent in the field of electrostatic development toner, can be employed, and, for example, various types of carbide such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various types of nitride such as boron nitride, titanium nitride and zirconium nitride; various types of boride such as zirconium boride; various types of oxide such as titanium oxide (titania), calcium oxide, magnesium oxide, zinc oxide, copper oxide, aluminum oxide, silica and colloidal silica; various types of titanic acid compounds such as calcium titanate, magnesium titanate and strontium titanate; sulfide such as molybdenum disulfide; various types of fluoride such as magnesium fluoride and carbon fluoride; various types of metal soap such as aluminum stearate, calcium stearate, zinc stearate and magnesium stearate; and various types of non-magnetic inorganic particles such as talc and bentonite; can be utilized alone or in combination.

Inorganic particles, particularly, such as silica, titanium oxide, alumina and zinc oxide are preferably surface treated by a well known method in the art employing hydrophobicity providing agents conventionally utilized such as a silane coupling agent, a titanate type coupling agent, silicone oil and silicone vanish, and further a treating agent such as a fluorine type silane coupling agent or a fluorine type silicone oil, a coupling agent provided with an amino group or a quaternary ammonium salt group, and modified silicone oil.

The mean primary particle diameter of inorganic particles utilized as an external additive is 5-100 nm, preferably 10-50 nm and more preferably 20-40 nm. By utilizing inorganic particles having such a particle diameter, it is possible to efficiently control adhesion stress of a toner to be in the aforesaid range.

The addition amount (G (% by weight)) of an external additive having the above-described particle diameter against toner particles is desirably an amount so as to make a product ($Dv_{50}$×G), of a volume median particle diameter ($Dv_{50}$ (μm)) and the addition amount, of 4-14, preferably of 5-13.5 and more preferably of 6-13. In the present invention, since the addition amount of an external additive can be set relatively small in this manner, it is considered that environmental stability of electrostatic chargeability of toner is improved. Herein, G means the total addition amount, when two or more kinds of external additives are utilized.

The present invention does not exclude further external additives, for example, "inorganic particles having a particle diameter out of the above-described range" and "organic particles" onto toner particles. The following organic particles may also be used as a cleaning aid or for other purposes, for example, styrene particles, (meth)acrylic particles, benzoguanamine particles, melamine particles, polytetrafluoroethylene particles, silicone particles, polyethylene particles and polypropylene particles, which have been made into particles by wet polymerization methods, for example, an emulsion polymerization method, a soap free emulsion polymerization method, a non-aqueous dispersion polymerization method and a gas phase method.

The electrophotographic toner of the present invention preferably has a volume median diameter ($Dv_{50}$) of volume particle diameter distribution of 2-7 μm.

Herein, the median diameter of toner particles refers to the 50% point in the volume particle diameter distribution. That is, when particle distribution of a certain number of toner particles is determined, counted are the number of toner particles having each particle diameter from a larger diameter or from a smaller diameter in order to determine the frequency, and a toner particle diameter which comes to the particle distribution portion representing 50% against the total toner particle number is called as a median diameter.

An electrophotographic toner of the present invention is preferably provided with a CV value in volume particle diameter distribution of 5-30. A CV value in volume particle distribution represents a degree of dispersion in volume particle distribution of toner particles, and is defined by the following equation. The smaller a CV value is, the sharper particle distribution is; which means that the diameter of toner particles is uniform.

$$CV\text{ value}=(\text{standard deviation in volume particle diameter distribution})/(\text{volume median diameter }(Dv_{50}))\times 100$$

[Measurement of Physical Properties of Toner]

(Volume Median diameter($Dv_{50}$) and CV Value)

Measurement of volume median diameter ($Dv_{50}$) and CV value of the toner can be carried out by using Coulter Multisizer III (produced by Beckman Coulter Inc.), connected with a computer system (produced by Beckman Coulter Inc.) for data processing. Measurement is carried out as follows: A surfactant solution is prepared, for example, by diluting a commercially available neutral detergent containing a surfactant with pure water by ten times. 20 ml of the surfactant solution is mixed with 0.02 g of toner. After making the toner blended with the surfactant solution, the mixture is subjected to an ultrasonic dispersion for one minute to obtain a toner dispersion. The toner dispersion is then poured, using a pipette, in a beaker containing ISOTON II (diluent; produced by Beckman Coulter Inc.) placed in a sample stand, until the content shown in the monitor increased to 5% by weight. The count number of particles is set at 25,000 and a 50 μm aperture is used.

An electrophotographic toner of the present invention may be utilized either as a full-color toner utilized in a full-color image forming apparatus or as a monochromatic toner utilized in a monochromatic image forming apparatus, however, is preferably utilized as a full-color toner. In a full-color image forming apparatus, generally generation of missing of an intermediate portion in the image is significant due to deterioration of transfer capability; however, it is possible to effectively prevent transfer capability from being deteriorated while keeping excellent environmental stability in chargeability of the toner by utilizing an electrophotographic toner of the present invention. In a full-color image forming apparatus, a solid image, in which toner layers of 1-4 are accumulated, is often formed, and in said solid image, since there exist regions where numbers of accumulated toner layers are different, a transfer pressure becomes higher where the number of accumulated toner layers is larger; therefore it is considered that generation of missing of an intermediate portion due to deterioration of a transfer capability becomes significant.

Further, an electrophotographic toner of the present invention may be utilized in an image forming apparatus provided with any type of fixing apparatus, however, it is preferably utilized in an image forming apparatus provided with a fixing apparatus of a type, in which the amount of a release oil coated on a fixing member such as a roller is reduced, that is a fixing apparatus in which the coating amount of release oil is not more than 4 mg/m$^2$. Specifically preferably, it is utilized in a fixing apparatus in which no release oil is coated. Conventional toner utilized in an image forming apparatus provided with such a fixing apparatus generally contains a release agent to prevent generation of high temperature offset, and a release agent is liable to be exposed on the surface of particles to deteriorate transfer capability resulting in significant generation of missing of an intermediate portion, however, an electrophotographic toner of the present invention has a tendency of a release agent not being exposed on the toner particle surface, it is possible to prevent deterioration of transfer capability while keeping excellent charging environmental stability.

Therefore, an electrophotographic toner of the present invention can most effectively exhibit the effects of the present invention in the case of being utilized as a full-color toner for oil-less fixing. That is, an electrophotographic toner of the present invention can prevent deterioration of transfer capability while maintaining excellent environmental stability in chargeability, even when being utilized in a full-color image forming apparatus provided with an oil-less fixing apparatus.

An electrophotographic toner of the present invention is preferably a negatively charging toner, and can be utilized either as a two-component developer, in which the toner has been mixed with a carrier, or as a single-component developer which does not employ a carrier.

EXAMPLES

In the following, the present invention will be detailed with reference to examples; however, embodiments of the present invention are not limited thereto. Herein, "part(s)" represents "weight part(s)".

[Preparation of Latex Particles]

(Preparation of Latex Particles (1))

(1) Preparation of Nuclear Particles (The First Step Polymerization)

(Dispersion Medium 1)

| | |
|---|---|
| Sodium dodecyl sulfate | 4.05 g |
| Ion-exchanged water | 2500.00 g |

In a 5000 ml separable flask equipped with a stirrer, a thermometer, a condenser and a nitrogen introducing device, above-described dispersion medium 1 was charged and temperature of the interior of the flask was raised to 80° C. while stirring at a rate of 230 rpm under nitrogen gas flow.

(Monomer Solution 1)

| | |
|---|---|
| Styrene | 568.00 g |
| n-Butyl acrylate | 164.00 g |
| Methacrylic acid | 68.00 g |
| n-Octyl mercaptan | 16.51 g |

Above-described dispersion medium 1 was added with an initiator solution, in which 9.62 g of a polymerization initiator (potassium persulfate) had been dissolved in 200 g of ion-exchanged water, above-described monomer solution 1 being titrated over 90 minutes, and the system was heated and stirred for 2 hours to perform polymerization (first polymerization), resulting in preparation of a latex dispersion. This is designated as "latex (1H)". A weight average particle diameter of latex (1H) was 68 nm.

(2) Formation of Intermediate Layer (The Second Step Polymerization/Mini-emulsion Polymerization)

(Monomer Solution 2)

| | |
|---|---|
| Styrene | 123.81 g |
| n-Butyl acrylate | 39.51 g |
| Methacrylic acid | 15.37 g |
| n-Octyl mercaptan | 0.72 g |
| HNP-0190 (non-polar wax, microcrystalline wax, manufactured by Nippon Seiro Co. Ltd.) | 47.00 g |
| LANOX FP-14 (polar wax, hard lanolin fatty acid ester, manufactured by Nippon Seika Co. Ltd.) | 2.35 g |

In a flask equipped with a stirrer, above-described monomer solution 2 was charged and heated at 80° C. to be dissolved, whereby a monomer solution was prepared.

(Dispersion Medium 2)

| | |
|---|---|
| $C_{12}H_{25}O(OCH_2CH_2)_3SO_3Na$ | 0.60 g |
| Ion-exchanged water | 800.00 g |

Subsequently, dispersion 2 was heated to 80° C. in a 1.8 L glass container, above-described monomer solution 2 being added, and the system was mixed and dispersed by use of a mechanical homogenizer "CLEARMIX" (produced by M Technique Co., Ltd.) provided with a circulation path at 80° C. for 1 hour, whereby a dispersion (a mini-emulsion) was prepared. Next, in a 5000 ml separable flask equipped with a stirrer, a thermometer, a condenser and a nitrogen gas introducing device, an emulsion containing 140 g of latex (1H) and 1600 g of ion-exchanged water was charged, a dispersion (a mini-emulsion) containing above-described monomer solution 2 being added rapidly after dispersion, whereby a mixed solution having an liquid temperature inside of the flask of 82° C. was prepared while being stirred at a rate of 230 rpm under nitrogen gas flow.

Subsequently, this mixed solution was added with a initiator solution in which 6.12 g of a polymerization initiator (potassium persulfate) was dissolved in 250 ml of ion-exchanged water, and the system was heated at 82° C. for 1-2 hours and stirred to perform polymerization (the second step polymerization), whereby prepared was a dispersion of complex resin particles having a structure in which the surface of latex (1H) particles were coated. This dispersion was designated as "latex (1HM)". Herein, the weight average molecular weight of 1HM latex was 50,000.

(3) Formation of Outer Layer (The Third Step Polymerization)

(Monomer Solution 3)

| | |
|---|---|
| Styrene | 343.64 g |
| n-Butyl acrylate | 85.47 g |
| n-Octyl mercaptan | 5.97 g |

In latex (1HM) prepared in the above manner, a initiator solution, in which 6.00 g of polymerization initiator (KPS) had been dissolved in 250 ml of ion-exchanged water, was added and above-described monomer solution 3 was dropped over 1 hour under a temperature condition of 82° C. After finished dropping, the system was heated for 2 hours and stirred to perform polymerization (the third step polymerization), followed by being cooled down to 28° C., whereby prepared was a dispersion of a complex resin having a core portion containing latex (1H), an intermediate layer containing the second step polymerized resin and an outer layer containing the third step polymerized resin and the aforesaid second step polymerized resin layer containing HNP-0190 (manufactured by Nippon Seiro Co., Ltd.) and LANOX FP-14. The complex resin was designated as Latex Particle (1). The THF soluble portion of Latex Particle (1) showed a primary peak at a weight average molecular weight of 30,000 in a GPC measurement, and the weight average particle diameter of this resin particles was 170 nm.

(Preparation of Latex Particle (2))

Latex Particle (2) was prepared in the same manner as preparation of Latex Particle (1) except that Fischer-Tropsh wax HNP-51 (manufactured by Nippon Seiro Co., Ltd.) was utilized instead of HNP-0190.

(Preparation of Latex Particle (3))

Latex Particle (3) was prepared in the same-manner as preparation of Latex Particle (1) except that paraffin wax HNP-9 (manufactured by Nippon Seiro Co., Ltd.) was utilized instead of HNP-0190.

(Preparation of Latex Particle (4))

Latex Particle (4) was prepared in the same manner as preparation of Latex Particle (1) except that paraffin wax HNP-11 (manufactured by Nippon Seiro Co., Ltd.) was utilized instead of HNP-0190.

(Preparation of Latex Particle (5))

Latex particle (5) was prepared in the same manner as preparation of latex particle (1) except that polyethylene type wax X-1195 (manufactured by Toyo Petrolite Co., Ltd.) was utilized instead of HNP-0190.

(Preparation of Latex Particle (6))

Latex particle (6) was prepared in the same manner as preparation of latex particle (1) except that acid type polar wax LICOWAX F (manufactured by Clariant Co., Ltd.) was utilized instead of LANOX FP-14.

(Preparation of Latex Particle (7))

Latex particle (7) was prepared in the same manner as preparation of latex particle (1) except that acid type polar wax LICOWAX E (manufactured by Clariant Co., Ltd.) was utilized instead of LANOX FP-14.

(Preparation of Latex Particle (8))

Latex particle (8) was prepared in the same manner as preparation of latex particle (1) except that acid type polar wax LICOCLUB WE4 (manufactured by Clariant Co., Ltd.) was utilized instead of LANOX FP-14.

(Preparation of Latex Particle (9))

Latex particle (9) was prepared in the same manner as preparation of latex particle (1) except that alcohol type polar wax PARACOHOL-5003A (manufactured by Nippon Seiro Co., Ltd.) was utilized instead of LANOX FP-14.

(Preparation of Latex Particle (10))

Latex particle (10) was prepared in the same manner as preparation of latex particle (1) except that alcohol type polar wax PARACOHOL-5001 (manufactured by Nippon Seiro Co., Ltd.) was utilized instead of LANOX FP-14.

Latex particle (11) was prepared in the same manner as preparation of latex particle (1) except that alcohol type polar wax PARACOHOL-5070 (manufactured by Nippon Seiro Co., Ltd.) was utilized instead of LANOX FP-14.

(Preparation of Latex Particle (12))

Latex particle (12) was prepared in the same manner as preparation of latex particle (1) except that the amount of methacrylic acid used in each step was changed to 0 g.

(Preparation of Latex Particle (13))

Latex particle (13) was prepared in the same manner as preparation of latex particle (1) except that the amount of methacrylic acid used in the Preparation of Nuclear Particles (The First Step Polymerization) was changed to 200.00 g from 68.00 g, and the amount of methacrylic acid used in the Formation of Intermediate Layer (The Second Step Polymerization/Mini-emulsion Polymerization) was changed to 47.37 g. from 15.37 g.

(Preparation of Latex Particle (14))

Latex particle (14) was prepared in the same manner as preparation of latex particle (1) except that the mixing composition of LANOX FP-14/HNP-0190 was changed to 1.0/40.0.

(Preparation of Latex Particle (15))

Latex particle (15) was prepared in the same manner as preparation of latex particle (1) except that the mixing composition of LANOX FP-14/HNP-0190 was changed to 20.0/40.0.

(Preparation of Latex Particle (16))

Latex particle (16) was prepared in the same manner as preparation of latex particle (1) except that the mixing composition of LANOX FP-14/HNP-0190 was changed to 40.0/40.0.

(Preparation of Latex Particle (17))

Latex particle (17) was prepared in the same manner as preparation of latex particle (1) except that the mixing composition of LANOX FP-14/HNP-0190 was changed to 0/47.0.

(Preparation of Latex Particle (18))

Latex particle (18) was prepared in the same manner as preparation of latex particle (1) except that the mixing composition of LANOX FP-14/HNP-0190 was changed to 47.0/0.

(Preparation of Latex Particle (19))

Latex particle (19) was prepared in the same manner as preparation of latex particle (1) except that the mixing composition of LANOX FP-14/HNP-0190 was changed to 1.0/47.0.

(Preparation of Latex Particle (20))

Latex particle (20) was prepared in the same manner as preparation of latex particle (1) except that the mixing composition of LANOX FP-14/HNP-0190 was changed to 64.0/47.0.

[Thermal Characteristics of Wax]

(Melting Point, Crystallization Temperature)

By use of a differential scanning calorimeter (DSC-200, produced by Seiko Instruments Inc.), 10 mg of a sample to be measured being precisely weighed to be charged into an aluminum pan, utilizing alumina charged in an aluminum pan as a reference; the sample, after having been heated from an ordinary temperature to 200° C. at a raising rate of 30° C./min, was cooled at a descending rate of 10° C./min to determine an exothermal peak accompanied with crystallization as a crystallization temperature, while measurement was performed between 20-120° C. at a raising rate of 10° C./min to determine a endothermic peak in a range of 78-100° C. at this raising temperature process as a melting point.

(Acid Value and Hydroxyl Value of Wax)

These were measured based on a method described in JIS K0070.

TABLE 1

| | Wax | Melting point/ ° C. | *1 | Acid value; mgKOH/g | Hydroxyl value; mgKOH/g |
|---|---|---|---|---|---|
| Polar wax | Acid type (—COOH) | | | | |
| | LICOWAX F (Clariant) | 77–83 | 65–70 | 6–10 | |
| | LICOWAX E (Clariant) | 79–85 | 65–75 | 15–20 | |
| | LICOCLUB WE4 (Clariant) | 78–85 | 65–75 | 20–30 | |
| | Alcohol type | | | | |
| | PARACOHOL-5003A (Nippon Seiro) | 78 | 70 | | 31 |
| | PARACOHOL-5001 (Nippon Seiro) | 71.7 | 65 | | 67 |
| | PARACOHOL-5070 (Nippon Seiro) | 103 | 95 | | 63 |

TABLE 1-continued

| | Wax | Melting point/ ° C. | *1 | Acid value; mgKOH/g | Hydroxyl value; mgKOH/g |
|---|---|---|---|---|---|
| | Hard lanolin fatty acid ester | | | | |
| | LANOX FP-14 (Nippon Seika) (pentaerythritol ester) | 70 | 63 | 5 | 95 |
| Non-polar wax | HNP-0190 (Nippon Seiro) | 80.2 | 78.3 | 0–0.1 | |
| | HNP-9 (Nippon Seiro) | 75.5 | 70.2 | 0–0.1 | |
| | HNP-11 (Nippon Seiro) | 68 | 62 | 0–0.1 | |
| | HNP-51 (Nippon Seiro) | 76.6 | 72.5 | 0–0.1 | |
| | X-1195 (Toyo Petrolite) | 72.3 | 68.3 | 0–0.1 | |

*1: Crystallization temperature/° C.

[Preparation of Pigment Particle]

(Preparation of Pigment Particle Dispersion (1))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of blue pigment (C. I. Pigment Blue 15:3) while being stirred, and subsequently subjected to a dispersion treatment by use of "CLEARMIX" (produced by M Technique Co., Ltd.), whereby a dispersion of colorant particles was prepared. The particle diameter of the dispersed blue pigment was measured by use of a dynamic light scattering particle diameter analyzer, ELS-800 (produced by Otsuka Electronics Co., Ltd.) to be 112 nm. This is designated as pigment dispersion (1).

(Preparation of Pigment Particle Dispersion (2))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of red pigment (C. I. Pigment Red 122) while being stirred, and subsequently subjected to a dispersion treatment by use of "CLEARMIX" (produced by M Technique Co. Ltd.), whereby a dispersion of blue colorant particles was prepared. The particle diameter of the dispersed blue pigment was measured by use of a dynamic light scattering particle diameter analyzer, ELS-800 (produced by Otsuka Electronics Co., Ltd.) to be 89 nm. This is designated as pigment dispersion (2).

(Preparation of Pigment Particle Dispersion (3))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of yellow pigment (C. I. Pigment Yellow 74) while being stirred, and subsequently subjected to a dispersion treatment by use of "CLEARMIX" (produced by M Technique Co., Ltd.), whereby a dispersion of blue colorant particles was prepared. The particle diameter of the dispersed blue pigment was measured by use of a dynamic light scattering particle diameter analyzer, ELS-800 (produced by Otsuka Electronics Co., Ltd.) to be 93 nm. This is designated as pigment dispersion (3).

(Preparation of Pigment Particle Dispersion (4))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of black pigment (carbon black) while being stirred, and subsequently subjected to a dispersion treatment by use of "CLEARMIX" (produced by M Technique Co. Ltd.), whereby a dispersion of blue colorant particles was prepared. The particle diameter of the dispersed blue pigment was measured by use of a dynamic light scattering particle diameter analyzer, ELS-800 (produced by Otsuka Electronics Co., Ltd.) to be 95 nm. This is designated as pigment dispersion (4).

[Preparation of Wax Dispersion]

(Preparation of Wax Dispersion (1))

In 1600 ml of ion-exchanged water, 59 g of $C_{12}H_{25}O(OCH_2CH_2)_3SO_3Na$ as an anionic surfactant were dissolved while stirring. This solution was heated at 85° C. and gradually added with 200 g of HNP-0190 (manufactured by Nippon Seiro Co., Ltd.) and 10 g of hard lanolin fatty acid ester, LANOX FP-14 (manufactured by Nippon Seika Co., Ltd.), to make wax fused. Subsequently, the system was dispersed by use of "CLEARMIX" (produced by M Technique Corp.), whereby a dispersion of wax particles was prepared. The particle diameter of the dispersed wax was measured by use of a dynamic light scattering particle diameter analyzer, ELS-800 (produced by Otsuka Electronics Co., Ltd.) to be 120 nm. This is designated as wax dispersion (1).

Next, in 250 g of wax dispersion (1) prepared in the above manner, an initiator solution, in which 0.4 g of a polymerization initiator (KPS) had been dissolved in 10 ml of ion-exchanged water, was added, and the following monomer solution was titrated over 2 hours under a temperature condition of 70° C. After finishing titration, polymerization was completed by heating and stirring for 2.5 hours. The particle diameter of the dispersed wax was measured by use of a dynamic light scattering particle diameter analyzer, ELS-800 (produced by Otsuka Electronics Co., Ltd.) to be 200 nm. This is designated as wax seed dispersion (1).

| | |
|---|---|
| Styrene | 6.95 g |
| n-Butyl acrylate | 2.30 g |
| Methacrylic acid | 0.81 g |
| n-Octyl mercaptan | 0.40 g |

Example 1

[Manufacturing of Cyan Toner 1]

<Preparation of Colored Particle (1)>

A mixed solution of 200.0 g (converted solid content) of latex particle (1) and 5 g (converted solid content) of pigment particle dispersion (1), and 900 g of ion-exchanged water were charged in a reaction vessel (a four-necked flask) equipped with a thermometer, a condenser, a nitrogen introducing device and a stirrer, and the mixture was stirred. After the temperature of the inside of the vessel was adjusted to 30° C., this solution was added with a 2M sodium hydroxide aqueous solution to adjust the pH to 10.0.

Subsequently, the resulting solution was added with an aqueous solution, in which 65.0 g of magnesium chloride.6 hydrate had been dissolved in 1000 ml of ion-exchanged water, over 10 minutes while stirring at 30° C. After standing for 3 minutes, the system was heated to 92° C. to perform formation of associated particles. In that state, the particle diameter of associated particles was measured by use of "Coulter Counter TA-II" and particle growth was stopped by addition of an aqueous solution, in which 80.4 g of sodium chloride had been dissolved in 1000 ml of ion-exchanged water, when the volume median diameter reached 4.5 μm, then fusion of particles and phase separation of crystalline substances were continued (a ripening process) by heating and stirring the system at a liquid temperature of 94° C. as a ripening process. In that state, the shape of associated particles was measured by use of "FPIA-2000" and the system was cooled down to 30° C. and stirring was stopped when the shape factor reached 0.965. The formed associated particles were filtered, repeatedly washed with ion-exchanged water of 45° C., followed by being dried with a hot wind of 40° C., whereby colored particles (1) was prepared. The volume median diameter and the circularity were measured again to be 4.5 μm and 0.966, respectively.

<External Addition Treatment>

Into the above prepared colored particles, hydrophobic silica (number average primary particle diameter=12 nm, hydrophobicity=68) was added to make a ratio of 1.0% by weight as well as hydrophobic titanium oxide (number average primary particle diameter=20 nm, hydrophobicity=63) was added to make a ratio of 1.2% by weight, and the system was mixed by a HENSCHEL MIXER to manufacture cyan toner 1. Herein, with respect to the colored particles, the shape and particle diameter were not changed by addition of hydrophobic silica and hydrophobic titanium oxide.

Example 2

[Manufacture of Cyan Toner 2]

<Preparation of Colored Particles (2)>

The above-described latex (1H) of 240 parts, 13.6 parts of wax dispersion (1), 24 parts of colored particle dispersion (1), 5 parts of an anionic surfactant (Neogen SC, manufactured by Daiichi Yakuhin Kogyo Co., Ltd.) and 240 parts of ion-exchanged water were charged in a reaction vessel equipped with a stirrer, a condenser and a thermometer, and the mixture was added with a 2M sodium hydroxide aqueous solution while being stirred to adjust the pH to 10.0. Subsequently, after adding 40 parts of a 50% by weight magnesium chloride aqueous solution thereto, the system was heated to 56° C. while being stirred and was kept standing for 1.0 hour. The volume median diameter of toner in the mixed dispersion was 4.3 μm. Next, after the temperature inside the system was cooled down to 75° C., 30 parts of latex (1H) being added, and then the system was heated to 94° C., 120 g of a 20% by weight sodium chloride aqueous solution being added, and kept standing for 6 hours. In that state, the shape of associated particles was measured by use of "FPIA-2000" and the system was cooled down to 30° C. and stirring was stopped when the shape factor reached 0.965. The formed associated particles were filtered, repeatedly washed with ion-exchanged water of 45° C., followed by being dried with a hot wind of 40° C., whereby colored particles (2) was prepared. The volume median diameter and circularity were measured again to be 4.7 μm and 0.970, respectively. Further, it has been confirmed that the toner surface is smooth and there is no exposure of pigment, by observation of the toner after drying through a SEM.

<External Addition Treatment>

Cyan toner 2 was manufactured by performing an external addition treatment in the same manner as example 1.

Example 3

Magenta toner 3 was manufactured in the same manner as example 1 except that pigment particle dispersion (1) was changed to pigment particle dispersion (2).

Example 4

Yellow toner 4 was manufactured in the same manner as example 1 except that pigment particle dispersion (1) was changed to pigment particle dispersion (3).

Example 5

Black toner 5 was manufactured in the same manner as example 1 except that pigment particle dispersion (1) was changed to pigment particle dispersion (4).

Example 6

Cyan toner 6 was manufactured in the same manner as example 1 except that latex particle (1) was changed to latex particle (2).

Example 7

Cyan toner 7 was manufactured in the same manner as example 1 except that latex particle (1) was changed to latex particle (3).

Example 8

Cyan toner 8 was manufactured in the same manner as example 1 except that latex particle (1) was changed to latex particle (4).

Example 9

Cyan toner 9 was manufactured in the same manner as example 1 except that latex particle (1) was changed to latex particle (5).

Example 10

Cyan toner 10 was manufactured in the same manner as example 1 except that latex particle (1) was changed to latex particle (6).

Example 11

Cyan toner 11 was manufactured in the same manner as example 1 except that latex particle (1) was changed to latex particle (7).

Example 12

Cyan toner 12 was manufactured in the same manner as example 1 except that latex particle (1) was changed to latex particle (8).

Example 13

Cyan toner 13 was manufactured in the same manner as example 1 except that latex particle (1) was changed to latex particle (9).

Example 14

Cyan toner 14 was manufactured in the same manner as example 1 except that latex particle (1) was changed to latex particle (10).

Example 15

Cyan toner 15 was manufactured in the same manner as example 1 except that latex particle (1) was changed to latex particle (11).

Example 16

Cyan toner 16 was manufactured in the same manner as example 1 except that latex particle (1) was changed to latex particle (13).

Example 17

Cyan toner 17 was manufactured in the same manner as example 1 except that latex particle (1) was changed to latex particle (14).

Example 18

Cyan toner 18 was manufactured in the same manner as example 1 except that latex particle (1) was changed to latex particle (15).

Example 19

Cyan toner 19 was manufactured in the same manner as example 1 except that latex particle (1) was changed to latex particle (16).

Example 20

Cyan toner 20 was manufactured in the same manner as example 1 except that latex particle (1) was changed to latex particle (19).

Example 21

Cyan toner 21 was manufactured in the same manner as example 1 except that latex particle (1) was changed to latex particle (20).

Comparative Example 1

Cyan toner 22 was manufactured in the same manner as example 1 except that latex particle (1) was changed to latex particle (12).

Comparative Example 2

Cyan toner 23 was manufactured in the same manner as example 1 except that latex particle (1) was changed to latex particle (17).

Comparative Example 3

Cyan toner 24 was manufactured in the same manner as example 1 except that latex particle (1) was changed to latex particle (18).

[Measurement of Physical Properties of Toner]

(Particle Diameter)

Measurement of volume median diameter ($Dv_{50}$) and CV value of the toner can be carried out by using Coulter Multisizer III (produced by Beckman Coulter Inc.), connected with a computer system (produced by Beckman Coulter Inc.) for data processing. Measurement is carried out as follows: A surfactant solution is prepared, for example, by diluting a commercially available neutral detergent containing a surfactant with pure water by ten times. 20 ml of the surfactant solution is mixed with 0.02 g of toner. After making the toner blended with the surfactant solution, the mixture is subjected to an ultrasonic dispersion for one minute to obtain a toner dispersion. The toner dispersion is then poured, using a pipette, in a beaker containing ISOTON II (diluent; produced by Beckman Coulter Inc.) placed in a sample stand, until the content shown in the monitor increased to 5% by weight. The count number of particles is set at 25,000 and a 50 μm aperture is used. The CV value was measured by use of UPA-ST150 (produced by Microtruck Corp.).

(Circularity)

Circularity is represented by "a circumferential length of an equivalent circle/a circumferential length of a projected image of a particle". Mean circularity was measured by use of a flow type particle image analyzer (FPIA-2000: produced by Sysmex Corp.) in a water dispersion.

(Molecular Weight)

Molecular weight was measured by use of a gel permeation chromatography (807-IT Type: produced by JASCO Corp.). Tetrahydrofuran as a carrier solvent was flown at 1 kg/cm$^2$ while keeping the column temperature at 40° C., and 30 mg of a sample to be measured were dissolved in 20 ml of tetrahydrofuran, which was introduced into an apparatus together with the above carrier solvent to determine the molecular weight based on polystyrene conversion.

TABLE 2

| | Volume Median diameter (μm) | CV | Circularity | Molecular weight | Horizontal Feret diameter (nm) |
|---|---|---|---|---|---|
| Example: 1 | 4.5 | 20 | 0.966 | 30,000 | 200 |
| 2 | 4.7 | 22 | 0.97 | 31,000 | 250 |
| 3 | 4.5 | 21 | 0.967 | 30,000 | 210 |
| 4 | 4.5 | 21 | 0.967 | 30,000 | 250 |
| 5 | 4.5 | 21 | 0.967 | 30,000 | 210 |
| 6 | 4.7 | 21 | 0.967 | 30,000 | 220 |
| 7 | 4.5 | 19 | 0.967 | 32,000 | 230 |
| 8 | 4.6 | 21 | 0.967 | 30,000 | 240 |
| 9 | 4.5 | 21 | 0.965 | 30,000 | 250 |
| 10 | 4.5 | 21 | 0.967 | 30,000 | 260 |
| 11 | 4.5 | 24 | 0.967 | 30,000 | 240 |
| 12 | 4.5 | 21 | 0.967 | 30,000 | 220 |
| 13 | 4.6 | 23 | 0.966 | 30,000 | 210 |
| 14 | 4.5 | 21 | 0.967 | 29,000 | 230 |
| 15 | 4.5 | 21 | 0.965 | 30,000 | 260 |
| 16 | 4.6 | 22 | 0.966 | 30,000 | 210 |
| 17 | 4.5 | 22 | 0.966 | 30,000 | 210 |
| 18 | 4.5 | 21 | 0.965 | 29,000 | 210 |
| 19 | 4.5 | 21 | 0.961 | 30,000 | 240 |
| 20 | 4.6 | 20 | 0.965 | 30,000 | 250 |
| 21 | 4.5 | 21 | 0.965 | 29,000 | 220 |
| Comparative example: 1 | 4.6 | 21 | 0.965 | 30,000 | 250 |
| 2 | 4.5 | 21 | 0.961 | 31,000 | 250 |
| 3 | 4.6 | 20 | 0.965 | 30,000 | 550 |

[Manufacture of Developer]

To evaluate toner prepared in the above-described examples and comparative examples as a two-component system developer, the toner was mixed with a ferrite carrier, which was covered with silicone resin and had a volume average particle diameter of 50 μm, whereby a developer having a toner concentration of 6% was prepared.

[Characteristic Evaluation of Toner]

(Crushing Index/Interface Adhesive Property)

Toner of 30 g, 1 g of titania (T805, manufactured by Nippon Aerosil Co., Ltd.) and 10 g of glass beads were charged in a vessel made of polyethylene, and after the mixture was stirred for 1 hour by use of TURBULA SHAKER (Type T2C, produced by Willy. Bachofen AG.), a crushing index was calculated according to the following equation from volume median diameters ($Dv_{50}$) before and after stirring which had been measured by use of Coulter Multisizer III (produced by Beckman Coulter Inc.) with an aperture tube of 50 μm.

Crushing index=[(a number of particles having a particle diameter of not more than 4.0 μm after 1 hour stirring)−(a number of particles having a particle diameter of not more than 4.0 μm before stirring)]/(a number of particles having a particle diameter of not more than 4.0 μm after 1 hour stirring)

The smaller a crushing index is, the less crushing is.

(Anti-peeling Property)

Solid image of 1.5 cm×1.5 cm (adhered amount of 2.0 mg/cm$^2$) was formed by use of a digital copier (SITIOS 9331; produced by Konicaminolta Business Technologies Inc.) equipped with an oil-less fixing device, and each image was folded into two by being bent at the center to visually evaluate the anti-peeling property of the image. The temperature difference between a fixing temperature, at which the image was slightly peeled off, and the lowest fixing temperature, at which the image was not peeled off at all, was designated as a lower limit fixing temperature.

A: The lower limit fixing temperature was not lower than 142° C. and lower than 146° C.

B: The lower limit fixing temperature was not lower than 146° C. and lower than 152° C. (being not problematic in practical use).

C: The lower limit fixing temperature was not lower than 152° C. (being problematic in practical use).

(Releasing Property, Anti-offset Property)

A halftone image was formed while varying the fixing temperature at 5° C. intervals over a range of 130-190° C. by use of a digital copier (SITIOS 9331; produced by Konicaminolta Business Technologies Inc.) with a fixing system speed of ½, and the offset state was visually observed to evaluate the temperature at which high temperature offset generated.

A: Offset temperature was not lower than 168° C.

B: Offset temperature was not lower than 160° C. and lower than 168° C.

C: Offset temperature was not lower than 155° C. and lower than 160° C. (being not problematic in practical use).

D: Offset temperature was lower than 155° C. (being problematic in practical use).

(Environmental Stability of Electrostatic Chargeability (Resistance of Environmental Stability))

Evaluation was performed based on a difference between a charging quantity of a developer after having been stored for 24 hours at a low temperature and low humidity (10° C., 15%) and a charging quantity of a developer after having been stored for 24 hours at a high temperature and high humidity (30° C., 85%).

A: The absolute value of difference was less than 7 μC/g.

B: The absolute value of difference was not less than 7 μC/g and less than 8 μC/g.

C: The absolute value of difference was not less than 8 μC/g.

TABLE 3

| | Crushing index | Anti-peeling property | Releasing property (Anti-offset property) | Environmental stability of chargeability |
|---|---|---|---|---|
| Example: 1 | 0.21 | A | A | A |
| 2 | 0.22 | A | A | A |
| 3 | 0.21 | A | B | A |
| 4 | 0.21 | A | B | A |
| 5 | 0.25 | A | B | A |
| 6 | 0.21 | A | B | A |
| 7 | 0.21 | A | B | A |
| 8 | 0.21 | A | B | A |
| 9 | 0.26 | A | B | A |
| 10 | 0.21 | A | B | A |
| 11 | 0.21 | A | B | A |
| 12 | 0.21 | A | B | A |
| 13 | 0.24 | A | B | A |
| 14 | 0.22 | A | B | A |
| 15 | 0.21 | A | B | A |
| 16 | 0.21 | A | B | A |
| 17 | 0.24 | A | B | A |
| 18 | 0.28 | A | B | A |
| 19 | 0.21 | A | C | A |
| 20 | 0.27 | A | B | A |
| 21 | 0.28 | A | B | A |
| Comparative example: 1 | 0.62 | B | C | A |
| 2 | 0.62 | B | B | C |
| 3 | 0.29 | A | D | A |

It is clear from table 3 that examples 1-21, which are electrophotographic toners of the present invention, exhibit considerably smaller crushing indexes compared to those of comparative examples 1-3, representing that the toner of the present invention is resistant to crushing, as well as, it is excellent in an anti-peeling property, a releasing capability (an anti-offset capability) and in environmental stability of electrostatic chargeability. Herein, comparative example 2 has a relatively small crushing index, however, is very poor in a releasing property (an anti-offset property) which is not allowable in practical use.

What is claimed is:

1. A method of manufacturing an electrophotographic toner comprising the step of:

associating, salting out and fusing resin particles and colorant particles in an aqueous medium, a mixture of a polar wax and a non-polar wax being comprised in the resin particles or in the aqueous medium, wherein (i) a toner particle comprises a domain in the toner particle, the domain comprising the polar wax having a first polar group and the non-polar wax;

(ii) the resin particle contains a second polar group;

(iii) the resin particle is prepared by polymerizing a mixture of polymerizable monomers comprising a radical polymerizable monomer having the second polar group; and (iv) a weight content of the radical polymerizable monomer having the second polar group is in the range of 0.1 to 15% by weight based on a total weight of the mixture of polymerizable monomers, wherein the weight ratio of the polar wax to the non-polar wax is in the range of 1/40 to 40/40.

2. The method of claim 1, wherein:

(i) the non-polar wax is a hydrocarbon;

(ii) endothermic peaks determined by DSC of the polar wax and the non-polar wax both appear in the range of 60 to 110° C.; and (iii) exothermic peaks determined by DSC of the polar wax and the non-polar wax both appear in the range of 55 to 100° C.

3. The method of claim 1, wherein the second polar group comprises at least one selected from the group consisting of: a heterocyclic group, a carboxyl group, an ester group, an ether group, a hydroxyl group, an amide group, an imino group, a nitro group, an amino group, an ammonium group, a sulfonyl group, a thiol group and a sulfide group.

4. The method of claim 1, wherein the non-polar wax comprises an alkane which may have a substituent or an alkene which may have a substituent.

5. The method of claim 1, wherein a volume median diameter of particles of the electrophotographic toner is 2 to 7 μm and a CV value is 5 to 30.

6. The method of claim 1, wherein the weight content of the polar wax is 15% by weight or less based on the total weight of the wax.

7. The method of claim 1, wherein the weight content of the polar wax is 12% by weight or less based on the total weight of the wax.

8. The method of claim 1, wherein the second polar group comprises at least one of a carboxyl group and a hydroxyl group.

9. The method of claim 1, wherein a number average horizontal Feret diameter of the domain is 0.1-1 μm.

10. The method of claim 1, wherein the resin particles comprising the mixture of the polar wax and the non-polar wax are obtained by an emulsion polymerization method.

11. The method of claim 1, wherein the resin particles comprising the mixture of the polar wax and the non-polar wax are obtained by a seed polymerization method using wax particles as nuclei.

* * * * *